US008250696B2

(12) United States Patent
Tozer

(10) Patent No.: US 8,250,696 B2
(45) Date of Patent: Aug. 28, 2012

(54) DEVICE FOR COLLECTION OF DEBRIS

(75) Inventor: Warrick Brook Tozer, Brighton (AU)

(73) Assignee: Aero-Tech Pty Ltd., Victoria (AU)

( * ) Notice: Subject to any disclaimer, the term of this patent is extended or adjusted under 35 U.S.C. 154(b) by 0 days.

(21) Appl. No.: 12/672,227

(22) PCT Filed: Aug. 25, 2008

(86) PCT No.: PCT/AU2008/001252
§ 371 (c)(1),
(2), (4) Date: May 26, 2010

(87) PCT Pub. No.: WO2009/026624
PCT Pub. Date: Mar. 5, 2009

(65) Prior Publication Data

US 2011/0113575 A1 May 19, 2011

(30) Foreign Application Priority Data

Aug. 30, 2007 (AU) ..... 2007904705

(51) Int. Cl.
*E01H 1/00* (2006.01)

(52) U.S. Cl. ..... 15/78; 172/29; 172/199; 172/612

(58) Field of Classification Search ..... 15/78, 79.1, 15/104.8, 160, 221; 172/29, 199, 612, 189, 172/297, 445.1, 684.5; 171/63, 211
See application file for complete search history.

(56) References Cited

U.S. PATENT DOCUMENTS 768,358 A 8/1904 Davis et al.
1,061,709 A 5/1913 Ward et al.
1,350,512 A 8/1920 Mowatt
1,448,385 A 9/1921 Bryant
1,530,329 A 3/1924 Roberts
1,503,329 A 7/1924 Mitchell
1,775,316 A 9/1930 McLeod et al.
(Continued)

FOREIGN PATENT DOCUMENTS

AU 13527/66 5/1968
(Continued)

OTHER PUBLICATIONS

McPherson's Industrial Catalog, Sep. 3, 1975, by McPherson's Ltd., p. 287.

(Continued)

*Primary Examiner* — Mark Spisich
*Assistant Examiner* — Michael Jennings
(74) *Attorney, Agent, or Firm* — Sughrue Mion, PLLC

(57) ABSTRACT

A device (10) for collecting debris from a ground surface (18). A flexible generally planar member (17) has openings (16) therethrough. When the device is laid on and forwardly moved over the ground surface (18) debris on the ground surface passes upwardly through the openings onto collection surfaces (25) of the device. The device has transversely extending barriers (67) positioned whereby, debris passing upwardly through the openings (16) passes upwardly over the barriers (67) and then downwardly to the following collection surface (25). The barriers (67) at least partially obstruct movement of collected debris on the collection surfaces (25) back into the openings (16) under deceleration of the device as it is forwardly moved over the ground surface.

9 Claims, 3 Drawing Sheets

U.S. PATENT DOCUMENTS

| | | | | |
|---|---|---|---|---|
| 1,786,194 | A | 12/1930 | Dickinson | |
| 1,997,248 | A | 4/1935 | Densberger | |
| 2,042,405 | A | 6/1935 | Knudson | |
| 2,287,133 | A | 12/1940 | Reiter | |
| 2,887,337 | A | 5/1959 | Begue | |
| 2,902,909 | A | 9/1959 | Reissinger | |
| 2,986,755 | A | 6/1961 | Sobie et al. | |
| 3,010,523 | A | 11/1961 | Gifford | |
| 3,263,755 | A | 8/1966 | Zink | |
| 3,823,962 | A | 7/1974 | Martin, Jr. | |
| 4,014,390 | A | 3/1977 | Teixeira | |
| 1,446,419 | A | 2/1983 | Glerum | |
| 4,379,569 | A | 4/1983 | Koch | |
| 4,505,338 | A | 3/1985 | Koval et al. | |
| 4,582,142 | A | 4/1986 | Bridge | |
| 4,651,450 | A | 3/1987 | York et al. | |
| 4,747,174 | A | 5/1988 | Hightower | |
| 4,836,295 | A | 6/1989 | Estes | |
| 5,018,587 | A | 5/1991 | Gandrud et al. | |
| 5,183,119 | A | 2/1993 | Wattenburg | |
| 5,284,211 | A | 2/1994 | Tozer | |
| 5,305,834 | A | 4/1994 | White | |
| 5,332,250 | A | 7/1994 | Thorwall et al. | |
| 5,588,174 | A | 12/1996 | Godfrey | |
| 5,918,684 | A * | 7/1999 | Tozer | 172/199 |
| 6,079,503 | A * | 6/2000 | Tozer | 172/199 |
| 6,139,043 | A | 10/2000 | Gries et al. | |
| 6,257,345 | B1 * | 7/2001 | Tozer | 172/199 |
| 6,454,018 | B2 | 9/2002 | Tozer | |
| 6,634,667 | B1 | 10/2003 | Tozer | |
| 7,124,463 | B2 * | 10/2006 | Mathews et al. | 15/84 |
| 7,249,429 | B2 * | 7/2007 | Truan et al. | 37/403 |
| 7,520,017 | B2 * | 4/2009 | Wilmo et al. | 15/83 |
| 2001/0038921 | A1 | 11/2001 | Tozer | |

FOREIGN PATENT DOCUMENTS

| | | | |
|---|---|---|---|
| AU | 198811471 | A1 | 8/1988 |
| BE | 876521 | | 9/1979 |
| CH | 669 812 | A5 | 4/1989 |
| CN | 2668691 | | 1/2005 |
| DE | 26 33 215 | A1 | 1/1978 |
| DE | 8218672 | U1 | 10/1982 |
| DE | 295 08 830 | U1 | 11/1996 |
| EP | 0 265 015 | A2 | 4/1988 |
| EP | 0 301 153 | A1 | 2/1989 |
| GB | 151 197 | A | 9/1920 |
| GB | 640312 | | 7/1950 |
| JP | 6-15064 | | 1/1994 |
| WO | 90/13712 | A | 11/1990 |
| WO | 95/20310 | A1 | 8/1995 |
| WO | 96/09440 | A1 | 3/1996 |
| WO | 98/29609 | A1 | 7/1998 |

OTHER PUBLICATIONS

European Search Report dated Feb. 29, 2008 for European Application No. 05740269.5.

International Search Report dated Aug. 1, 1990 for International Application No. PCT/AU90/001730.

International Search Report dated Jul. 4, 2005 for International Application No. PCT/AU2005/000692.

International Search Report dated Jan. 2, 1996 for International Application No. PCT/AU95/00629.

* cited by examiner

DEVICE FOR COLLECTION OF DEBRIS

FIELD OF THE INVENTION

This invention relates to a device for collection of debris.

BACKGROUND OF THE INVENTION

U.S. Pat. No. 5,284,211 and International Patent Application No. WO/1996/009440 disclose debris collection devices suitable, for example, for collecting small debris from a ground surface. These are each in the form of a mat-like structure having openings therethrough. The mat-like structure is laid on the ground surface and moved over the surface so the debris passes from the ground surface upwardly through the openings to rest on the upper surface of the structure. The device may then be moved to a suitable location at which the collected debris on the upper surface of the structure is removed, such as by up-ending the device. For example, the device of U.S. Pat. No. 5,284,211 has been found useful for clearing leaves from, and generally grooming, en tout cas tennis courts, and the arrangement of WO/1996/009440 useful for a variety of applications, including clearing debris such as bolts, screws, nuts washers and other foreign object debris, so called "FOD", from aircraft runways.

Arrangements such as shown in U.S. Pat. No. 5,284,211 and international application WO/1996/009440 have been found to be very satisfactory in use, offering a relatively inexpensive alternative to, for example, mechanical sweeping devices using rotary brushes. However, it has been noticed that, sometimes, there is a tendency for collected material on the mat structure to fall back through the openings in it, and be lost again. This tendency particularly occurs under abrupt deceleration of the device when it is being moved over the ground surface. Loss of collection efficiency due to this can be limited by ensuring that this deceleration is always relatively gentle, but it would be advantageous to be freer of this operational constraint.

SUMMARY OF THE INVENTION

In one aspect, the invention provides a device for collecting debris from a ground surface, comprising a flexible generally planar member with an opening therethrough such that when the device is laid on and forwardly moved over a ground surface debris on the ground surface passes upwardly through the opening onto a collection surface of the device, the device having a transversely extending barrier positioned whereby, in use, debris passing upwardly through the opening passes upwardly over the barrier and then downwardly to the collection surface, the barrier at least partially obstructing movement of collected debris on the collection surface back into the opening under deceleration of the device as it is forwardly moved over the ground surface.

The barrier may be in the form of a transverse wall arranged such that, in an in-use condition of the device, it extends upwardly and is positioned behind and adjacent said opening, and at a forward location with respect to the collection surface.

The wall may have first and second opposed surfaces extending transversely of the device, these being arranged and configured so that in said in use condition the first surface is behind the opening and is inclined to extend upwardly and rearwardly from a lower location to a higher more rearward location, and the second surface is behind the first surface; extending generally downwardly from an upper location to a lower location adjacent the collection surface, the first surface being disposed to then, in use of the device, facilitate rearward flow of debris from the opening along and up the first surface to be carried under momentum of the debris past the wall to the collection surface, and said second surface acting to at least partially inhibit movement of collected debris back to the opening under deceleration of the device, by pile-up of the material against the second surface.

The first surface may form a substantially continuous surface with an inclined surface extending upwardly and rearwardly from a transverse edge of said opening which, in said in use condition, forms a rear edge of the opening.

The first surface and the second surface may at least substantially meet at an apex of said wall.

The wall may extend to a distance from the collection surface which is in the range 5 mm to 25 mm above the collection surface in the condition for use of the device.

The wall may extend substantially from side to side of the device.

The planar member may define a section thereof, in use being behind the opening, a surface of which section is uppermost in the condition for use of the device and forms the collection surface.

The section may have an underside formed of conformable material so that, in use of the device, the underside may locally conform to undulations in the ground surface.

In one form, the section is formed from a flexible layer having depending bristles.

BRIEF DESCRIPTION OF THE DRAWINGS

The invention is further described by way of example only with reference to the accompanying drawings in which.

DETAILED DESCRIPTION OF THE PREFERRED EMBODIMENTS

Figure 1:
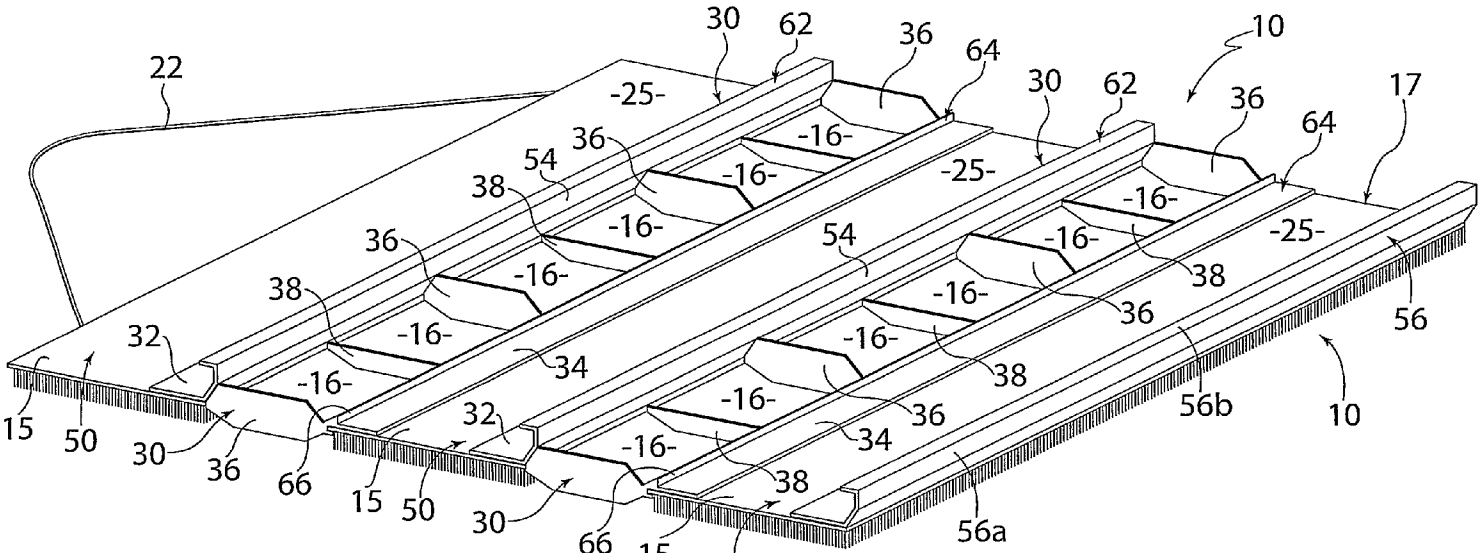
FIG. 1 is a perspective view of a debris collection device constructed in accordance with the invention.
Figure 2:
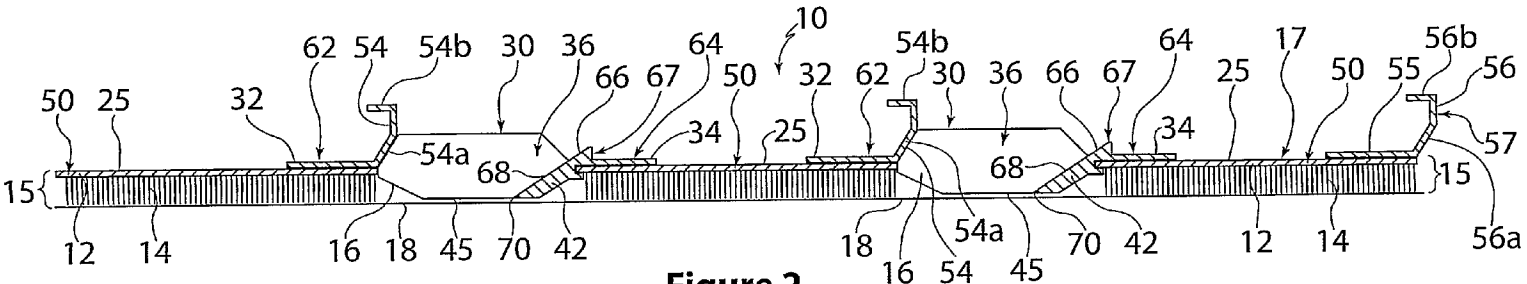
FIG. 2 is fragmentary vertical front to rear cross section of the device of FIG. 1.

The debris collection device 10 shown is formed as a flexible generally planar member 17 having sections 50 formed from conformable matting material 15 having, as shown in FIG. 2, a flexible laminar base portion 12 with depending bristles 14. There are three sections 50 arranged at lengthwise spaced locations, separated by two transverse frame structures 30. It has been found convenient to form the device from inverted artificial grass material of the kind used for the surfaces of tennis courts and the like, arranged with the bristles extending downwardly.

The device 10 has rectangular sidewardly elongate openings 16, there being a respective transversely extending row of the openings defined by each frame structure 30. When the device 10 is moved over a ground surface 18 (FIG. 2), such as by towing by use of a rope 22 at a forward end thereof, the bristles 14 agitate leaves, stones and the like on the ground surface by contact therewith and this debris tends to pass from the underside of the device 10 through the openings 16 to rest on upper collection surfaces 25 of sections 50. The debris so resting on the upper side of the device 10 can be then conveniently taken away on the device for disposal as desired.

In the illustrated embodiment, there are six openings 16 formed in each frame structure 30. Rows of the openings 16 in each of the frame structure 30 are respectively interposed, in the front-to-rear direction, between forward and intermediate ones of the sections 50, and the intermediate and rear ones of sections 50.

A leading frame structure 30 is secured at a transverse leading edge portion 32 thereof to a transverse trailing edge portion of a forward one of the sections 50, and at a trailing edge portion 34 to the a leading edge portion of an intermediately positioned one of the sections 50. A trailing frame structure 30 is secured at transverse leading and trailing edge portions 32, 34 respectively to a transverse trailing edge portion of the intermediately positioned section 50, and to a transverse leading edge portion of a trailing section 50.

Figure 3:
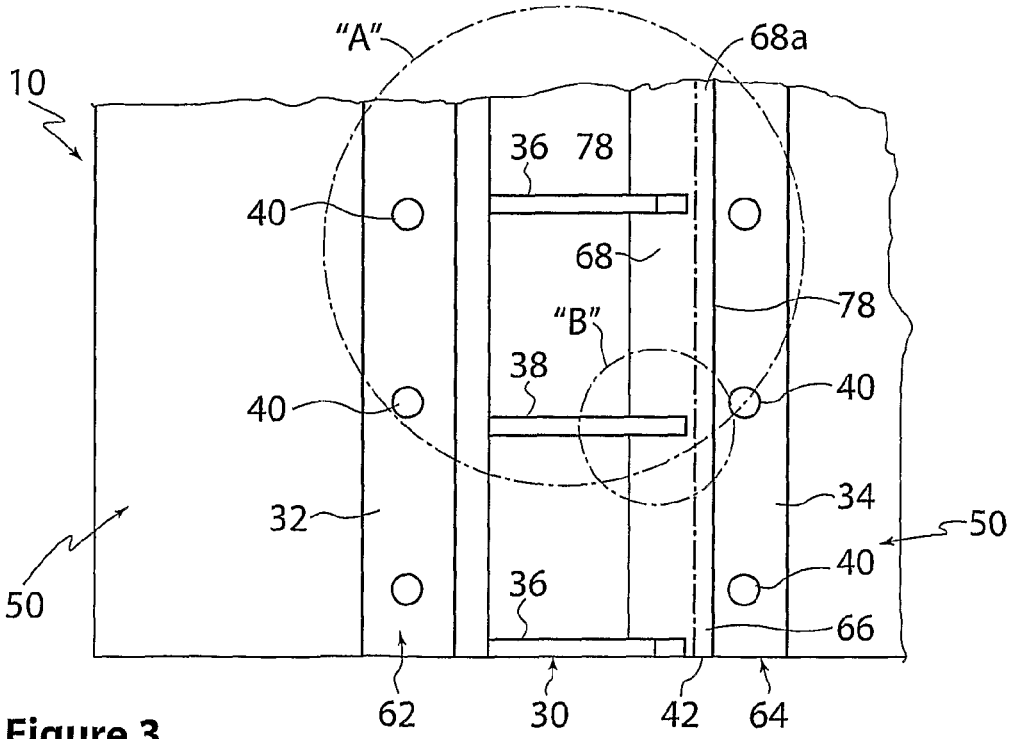
FIG. 3 is a fragmentary plan view of the device of FIG. 1.

The frame structures 30 may for example be secured to the sections 50 by use of bolts or other fixture elements 40 (FIG. 3), which extend through the edge portions 32, 34 of the frame structures 30 and the matting material 15. Alternatively, the sections might for example be stitched to the edge portions 32, 34.

Edge portions 32, 34 are formed as respective forwardly and rearwardly extending parts of leading and trailing transverse elements 62, 64 of the respective frame structure 30, and are generally coplanar. The edge portions 32, 34 overly the respective adjacent upper edge portions of sections 50 to which they are secured.

The openings 16 in each frame are defined between the leading and trailing transverse elements 62, 64 thereof and front to rear extending fin-like walls 36, 38 of each frame structure. Walls 36, 38 extend between and interconnect the transverse elements 62, 64. There are, in the illustrated device 10, four walls 36 for each frame structure 30, one outer one at each lateral side of the respective frame structure 30, and two inner ones positioned at locations one third of the distance inwards from a respective one of the outer walls 36. Each frame structure has three walls 38, each positioned midway between pairs of the walls 36. Walls 36, 38 are generally planar and vertically extending, and of relatively small thickness in the side to side direction of the device 10.

Each wall 36, 38 has a lower edge portion 45 which in the in-use position of the device 10, is parallel to and either rests on or is just above the ground surface 18. Walls 38 are of comparatively lesser height than walls 36, but are otherwise of similar form to walls 36.

Figure 4:
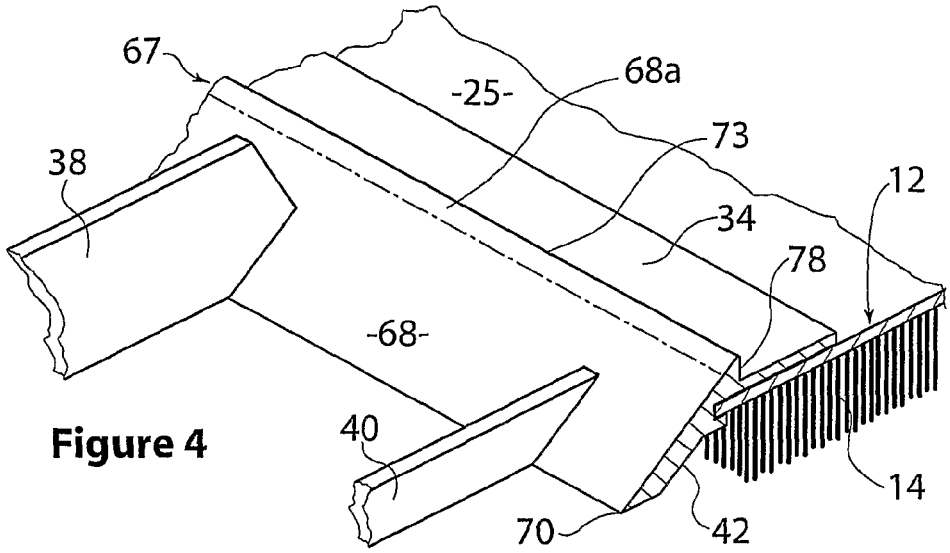
FIG. 4 is a perspective view of part of the device of FIG. 1, in the region "A" in FIG. 3.

Trailing edges of the openings 16 of each frame structure 30 are defined by portions of the leading edge 70 of a transverse sloping pick-up portion 42 formed on the respective trailing transverse element 64. Each pick-up portion 42 has a front surface 68 that extends upwardly and rearwardly from the respective edge 70 at an acute angle to the ground surface 18. The pick-up portions join at the upper rear with forward parts of the portions 34 of the respective transverse element 64. The upper part of each pick-up portion 42 defines an upstanding wall 66 which terminates a short distance above the upper surface of the trailing edge portion 34 of the respective frame structure 30, and thus also a short distance above the upper surface 25 of the following section 50. Each wall 66 has an upwardly and rearwardly extending sloping front surface 68*a* (FIGS. 4 and 5) forming a continuation of the sloping upper surface 68 of the respective pick-up portion 42. The upper edge of each surface 68*a* terminates at an apex 73 of the respective wall 66. A rear surface 78 of each wall 66 extends downwardly from apex 73 to the edge portion 34 of the respective frame structure 30, and substantially notivally thereto.

Each forward transverse element 62 has an upstanding wall 54. Wall 54 has a generally upright part 54*a* extending upwardly from the rear edge of portion 32 and a part 54*b* that extends forwardly from the upper end of part 54*a* hereof. At the upper rear margin of the rearmost section 50, there is provided a side to side extending member 57, having a transversely extending flat portion 55 secured to the rear side to side margin of section 50 and having at the rear edge thereof an upstanding wall 56 similar to walls 54, having an upright part 56*a* extending upwardly from the rear edge of portion 32 and a part 56*b* that extends forwardly from the upper end of part 56*a*.

Figure 5:
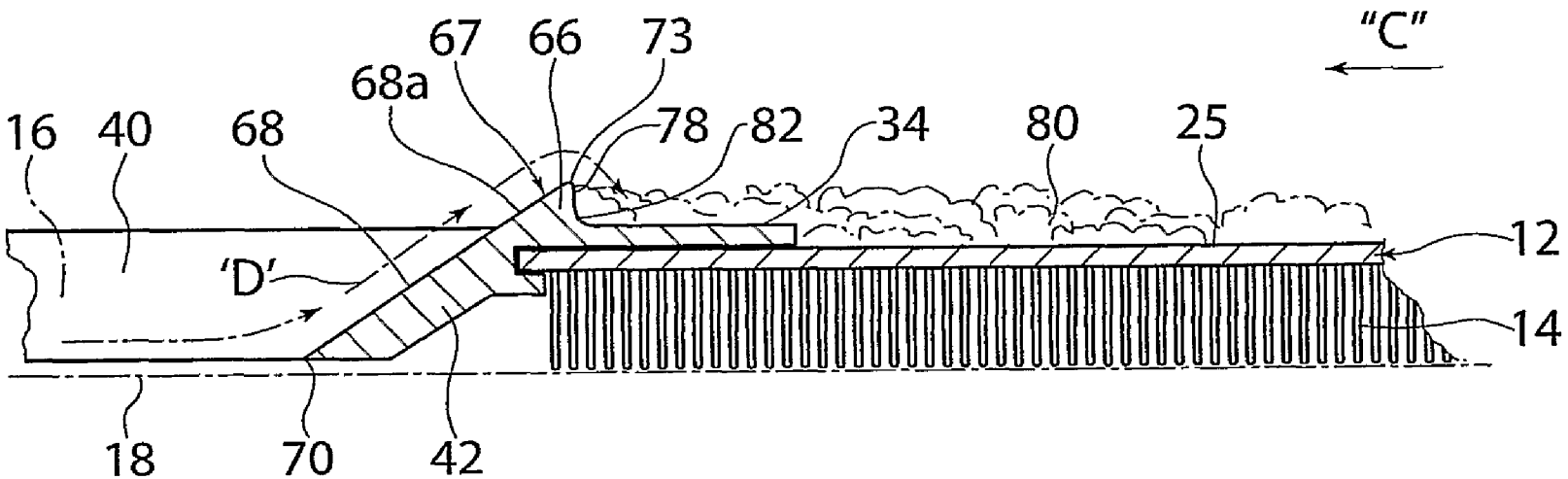
FIG. 5 is an enlarged front to rear upright cross section in the region "B" in FIG. 3.

The walls 54, 56 present barriers serving to inhibit rearward movement of collected debris off the mat sections 50 during use of the device 10, so as to lessen loss of collected material from the device. That is, as collected debris accumulates on the surfaces 25, there is a tendency for this debris to move rearwardly, due to the continuing forward movements of the device 10, and the walls 54, 56 restrict movement of the collected debris back over the rear edges of the collection surfaces. The walls 66 serve to inhibit forward movement of collected debris 80 from the intermediate and rear mat sections 50 from passing forwardly back into the openings 16 immediately in front thereof, during deceleration of the device 10 as it is used. In particular, under deceleration, during forward movement of device 10, resultant forward movement of the collected debris 80 along collection surfaces 25, in the direction "C" in FIG. 5, is at least in part obstructed by piling up of the debris 80 against the upstanding wall surfaces 78. On the other hand, the sloping front surfaces 68*a* of the walls 66 facilitate flow of debris 80 picked up by the device to pass upwardly and rearwardly along the pick-up portions 42, upwardly of rearwardly to clear the apexes 73 of the walls 66 to fall and be collected on the collection surfaces 25 of the intermediate and rear mat sections 50. This movement of debris along surface 68 of pick-up portions 42 and over the adjacent wall 66 is illustrated by path "D" in FIG. 5. By this, the walls 66 form respective barriers 67 to impede forward movement of collected debris, while permitting rearward flow thereover to the collection surfaces.

The described device has been found to be particularly satisfactory for cleaning debris from hard surfaces such as asphalt, concrete or the like, as well as from grass and similar surfaces. It has also been found satisfactory for use in collecting small items such as nuts, bolts or the like such as from aircraft runways. With rough asphalt in particular, the collecting action is very efficient, the bristles 14 acting to clean the ground surface, directing debris to the upper surface of the device.

In one foam of the invention, it was found satisfactory to provide openings 16 of dimensions of the order of 260 mm by 60 mm width in front rear length, with the depth of the pile formed by the bristles 14 being of the order of 1 cm. The sizes may however be varied as necessary to adapt the invention to particular uses. For example, the openings 16 may be of the order of 10 to 300 mm length, measured in the front to rear direction of the device of the invention. At towing speeds of up to 30 Kph, a length of about 70 mm may be satisfactory, with greater lengths being employed with faster towing speeds, for example 100 mm where speeds up to 100 Kph are employed. Similarly, the depth of the pile provided by the bristles 14 may be varied. Generally, the longer the bristles, the better is the wearability, but shorter bristles are generally more efficient, since it is easier to direct objects through a lesser distance from the ground surface to the upper surface of the device. Practically, for small objects such as washers or the like a pile thickness of about 9 mm may be satisfactory. For large objects, greater depth may be employed. A choice of overall thickness of matting material of 5 to 15 mm will provide satisfactory pick-up of a range of commonly encountered small objects.

The bristles 14 should generally be flexible, and some degree of resilience is also desirable.

In an exemplary construction, the matting material 15 was artificial grass material, the bristles 14 being formed of polypropylene fibres and about 10 mm in length. The resultant mat-like structure is crushable by impression of hand pressure on the bristles (i.e. upwardly crushable), but has sufficient resilient to cause reasonably quick restoration to the original condition when pressure is removed. This artificial grass material is relatively flexible, the base material being flexible.

The described artificial matting material presents an undersurface constituted by the bristles which is readily able to conform to local variations in ground surface as the device 10 is passed over the ground surface, in particular being able to conform to surface undulations as well as accommodating small obstacles, and providing an effective sweeping action to agitate debris and cause it to move through the openings 16. While it is preferred that the device include a flexible base with a conformable portion in the form of the described bristles, other constructions are possible. For example, a layer of foamed plastics material could be used. In general, the whole of the device 10 should be flexible, although, particularly if a very thick under layer constituted by bristles, foam or other material is employed, this could be secured to a relatively rigid upper backing. The leading edge of the device may be provided with a rigid element to facilitate maintenance of the device in a spread out condition during towing over a surface.

The configuration and height of the wall 66 may be chosen to suit that particular kind of debris to be collected. For general use, a height of between 5-25 mm may be useful.

In general, the height may be greater for larger types of material to be collected and smaller for smaller types of material. That is, smaller types of material may have lesser forward momentum when collected, so that forward movement under deceleration of the device may be more easily resisted. Also, the relatively greater momentum of heavier material when passing upwardly from openings 16 may enable them to be efficiently carried rearwardly over a higher barrier 67.

Figure 6:
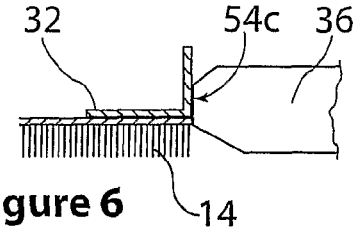
FIG. 6 is an enlarged front-to-rear cross sectional view of part of a modified frame structure of the device of FIGS. 1 to 5.

The walls 54 may be alternatively formed as simple transverse upstanding elements 54*c* as shown in FIG. 6, and wall 56 may be similarly formed.

As shown in FIG. 5, the walls 66 forming barriers 67 preferably join to the respective edge portions 34 at respective radiused filet portions 82, so that the rear surfaces 78 of walls 66 merge smoothly with the upper surface of the respective portion 34. By this, root portions of the walls 66 are of greater width viewed in transverse section as in FIG. 5, and there is no sharp corner between these surfaces. This aids in strengthening the walls 66. Also, the arrangement assists by inhibiting catching of debris in the corners between surfaces 78 and surfaces of edge portion 34, when the device 10 is lifted to shake debris forwardly and out of the device 10.

In general, the dimension of the openings 16 in the front to rear direction of the device may be about the same or slightly greater than the front to rear lengths of the sections 50. The device may be of any convenient dimensions. A length of the order of 1.5 meter and a width of the order of 2.4 meters may be satisfactory for general manual use.

The described construction has been advanced merely by way of example and many modifications and variations may be made without departing from the spirit and scope of the invention, which includes every novel feature and combination of features herein disclosed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge.

The invention claimed is:

1. A device for collecting debris from a ground surface, comprising a flexible generally planar member with an opening therethrough such that when the device is laid on and forwardly moved over the ground surface debris on the ground surface passes upwardly through the opening onto a collection surface of the device, the device having a transversely extending barrier positioned whereby, in use, debris passing upwardly through the opening passes upwardly over the barrier and then downwardly to the collection surface, the barrier at least partially obstructing movement of collected debris on the collection surface back into the opening under deceleration of the device as it is forwardly moved over the ground surface, the barrier being in the form of a transverse wall arranged such that in an in-use condition of the device, it extends upwardly and is positioned behind and adjacent said opening, and at a forward location with respect to the collection surface, said wall having first and second opposed surfaces extending transversely of the device, these being arranged and configured so that in said in use condition the first surface is behind the opening and is inclined to extend upwardly and rearwardly from a lower location to a higher more rearward location, and the second surface is behind the first surface, extending generally downwardly substantially normally to the collection surface from an upper location to a lower location adjacent the collection surface the first surface being disposed to then, in use of the device, facilitate rearward flow of debris from the opening along and up the first surface to be carried under momentum of the debris past the wall to the collection surface, and said second surface acting to at least partially inhibit movement of collected debris back to the opening under deceleration of the device, by pile-up of the material against the second surface.

2. A device as claimed in claim 1 wherein the first surface forms a substantially continuous surface with an inclined surface extending upwardly and rearwardly from a transverse edge of said opening which, in said in use condition, forms a rear edge of the opening.

3. A device as claimed in claim 1 wherein said first surface and said second surface at least substantially meet at an apex of said wall.

4. A device as claimed in claim 1 wherein the wall extends to a distance from the collection surface which is in the range 5-25 mm above the collection surface in the condition for use of the device.

5. A device as claimed in claim 1 wherein the wall extends substantially from side to side of the device.

6. A device as claimed in claim 1 wherein the planar member defines a section thereof, in use being behind the opening, a surface of which section is uppermost in the condition for use of the device and forms the collection surface.

7. A device as claimed in claim 6 wherein the section has an underside formed of conformable material so that, in use of the device, the underside may locally conform to undulations in the ground surface.

8. A device as claimed in claim 7 wherein the section is formed from a flexible layer having depending bristles.

9. A device as claimed in claim 1, wherein said second surface at a lower location includes a convex surface portion which extends downwardly and rearwardly so that the wall has a thickened lower root portion.

* * * * *